US005400439A

United States Patent [19]

Petroff

[11] Patent Number: 5,400,439

[45] Date of Patent: Mar. 28, 1995

[54] HI-FASHION, KNOTTLESS NECKTIE

[75] Inventor: Jordan Petroff, Harrisburg, Pa.

[73] Assignee: Earl F. Clifford, Trustee; Harrisburg, Pa.

[21] Appl. No.: 159,743

[22] Filed: Nov. 30, 1993

[51] Int. Cl.[6] ..... A41D 25/00; A41D 25/02; A41D 25/04

[52] U.S. Cl. ..... 2/148; 2/149; 2/150; 2/152.1; 2/153; 2/155

[58] Field of Search ..... 2/52, 144, 145, 148, 2/149, 150, 152.1, 153, 155, 156, 157, 146, 147

[56] References Cited

U.S. PATENT DOCUMENTS

| | | | |
|---|---|---|---|
| 908,768 | 1/1909 | Hagan . | |
| 1,482,560 | 2/1924 | Hewes | 2/156 |
| 2,040,297 | 5/1936 | Costantini | 2/150 |
| 2,100,870 | 11/1937 | Petrie et al. | 2/145 |
| 2,294,508 | 9/1942 | Minor | 2/150 |
| 3,030,631 | 4/1962 | Tobias | 2/150 |
| 3,950,790 | 4/1976 | Adler | 2/144 |
| 3,955,217 | 5/1976 | Levy | 2/150 |
| 4,368,544 | 1/1983 | Smith | 2/153 |
| 4,575,872 | 3/1986 | Chen | 2/150 X |
| 4,875,239 | 10/1989 | Paterson, Jr. | 2/152 R |
| 4,972,523 | 11/1990 | Begg | 2/145 |
| 5,088,120 | 2/1992 | Yen | 2/145 |
| 5,257,419 | 11/1993 | Alexander | 450/155 X |

FOREIGN PATENT DOCUMENTS

| | | | |
|---|---|---|---|
| 193317 | 10/1937 | Switzerland | 2/153 |

*Primary Examiner*—Jeanette E. Chapman
*Attorney, Agent, or Firm*—Earl F. Clifford

[57] ABSTRACT

The Knotless Necktie is a three component, easy to assemble and adjust, necktie that gives the appearance of being a fashionable knotted necktie but which does not use a knot and eliminates any knot tieing. This necktie is comprised of a display streamer, a knotshaper and a neckband. Each of these components can be made of the same or of different materials, design patterns or colors. These components are easily assembled into a complete, ready to wear necktie. From the components of three knotless neckties, each of a different material, design pattern and color, nine different and fashionable knotless neckties can be assembled. Once the knotless necktie is assembled and adjusted for the wearer's neck size, no further adjustment is needed. This necktie can then be easily taken-off or put-on while maintaining the appearance of a fashionably knotted conventional necktie.

8 Claims, 5 Drawing Sheets

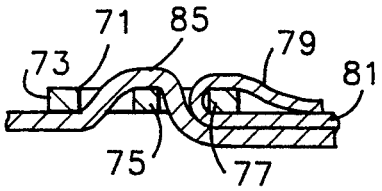
FIG. 4
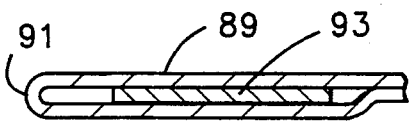
FIG. 5
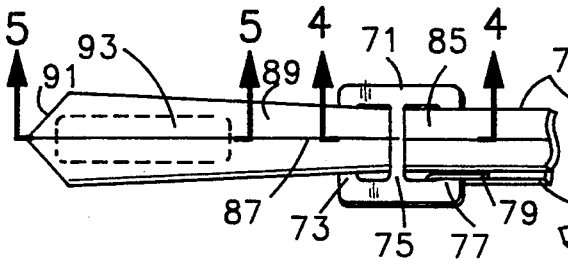
FIG. 3
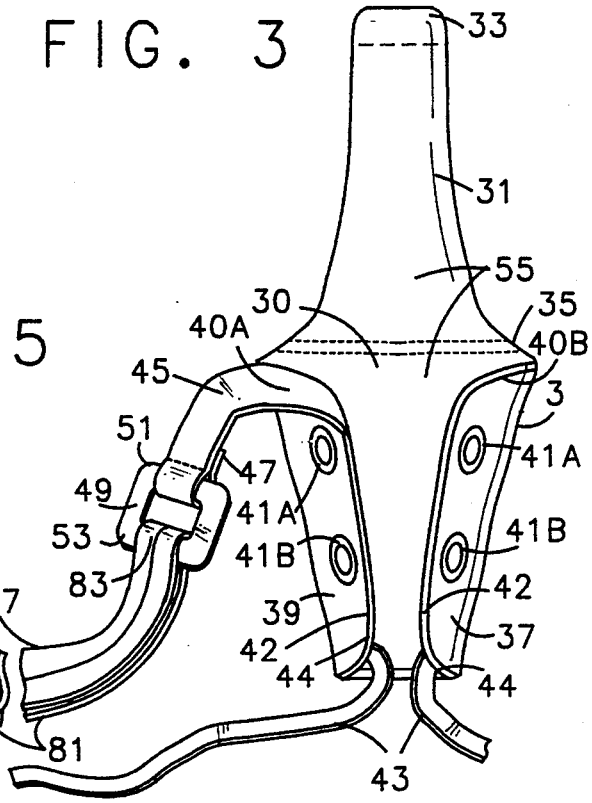
FIG. 6
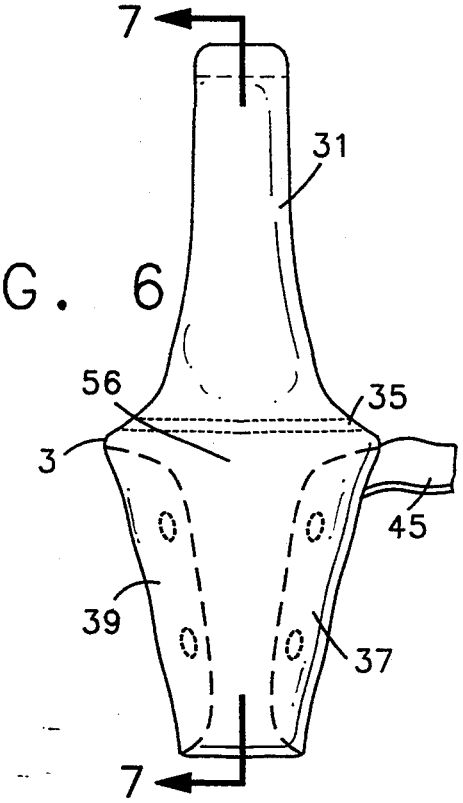
FIG. 7
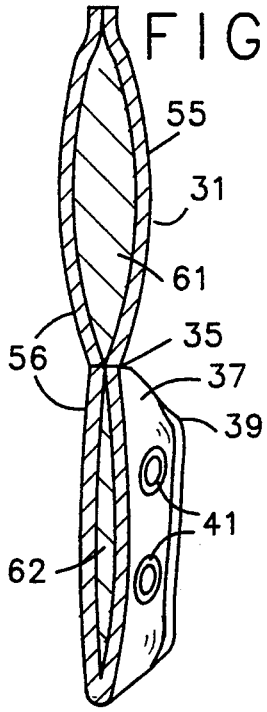

FIG. 8
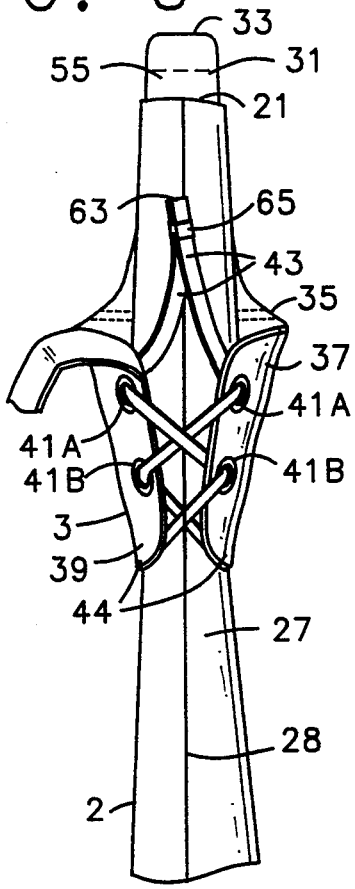
FIG. 9
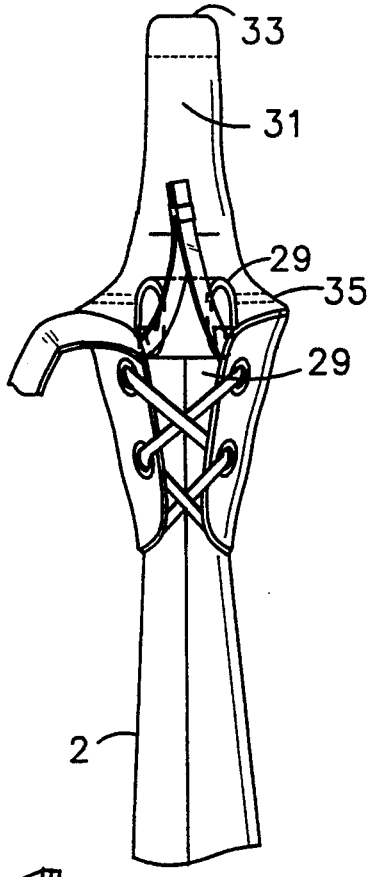
FIG. 10
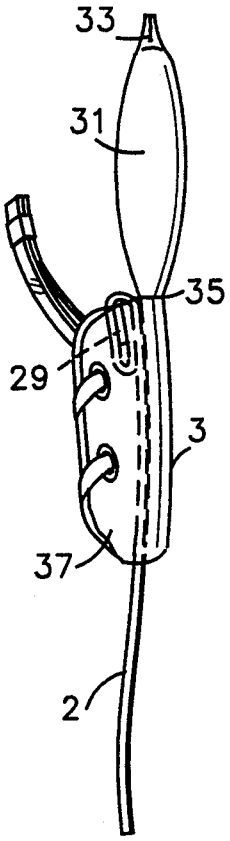
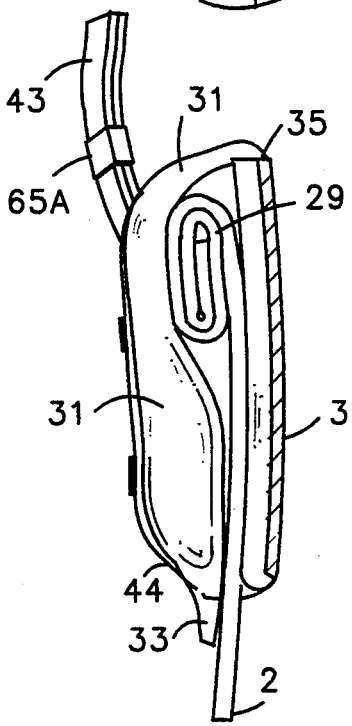
FIG. 11

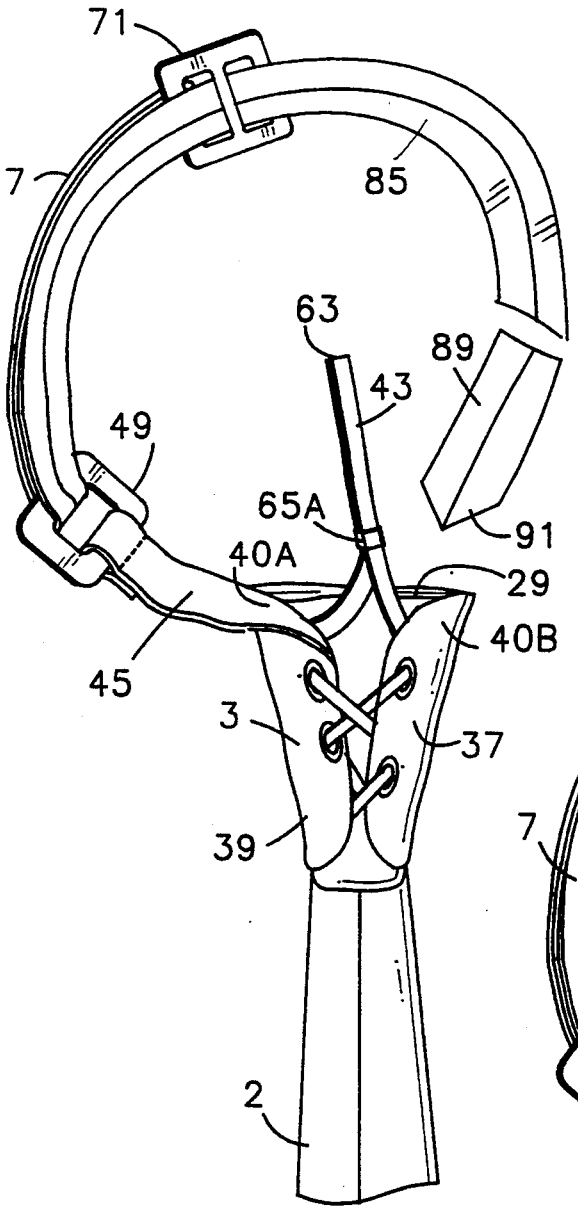
FIG. 12
FIG. 13
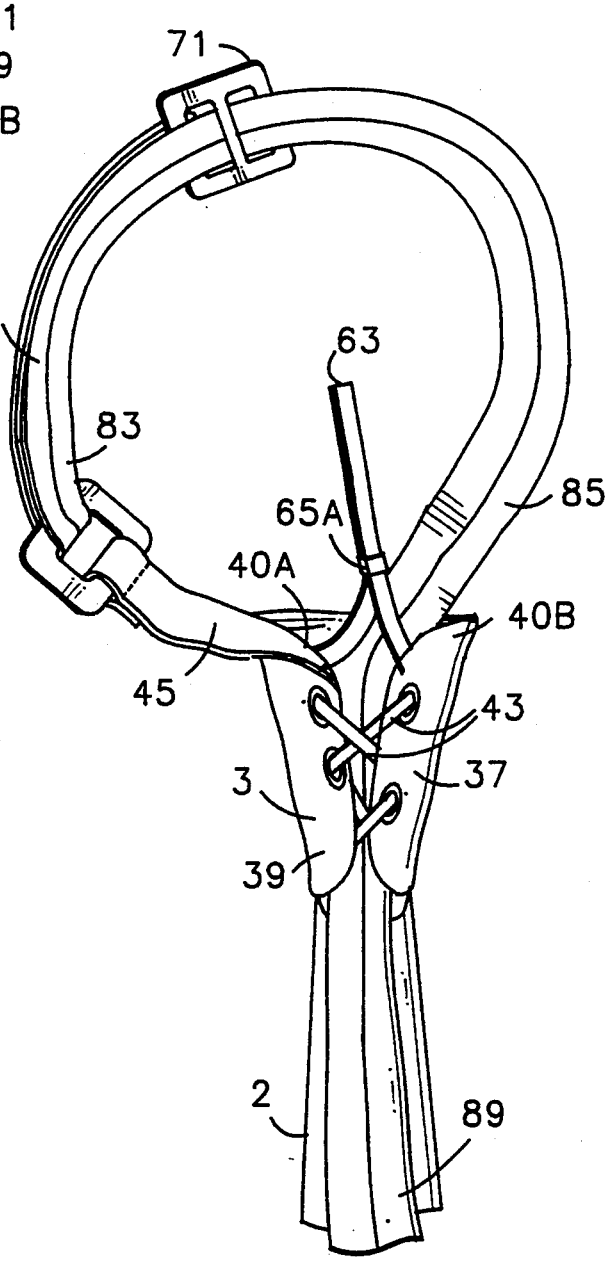

HI-FASHION, KNOTTLESS NECKTIE

BACKGROUND OF THE INVENTION

1. Field of the Invention

The present invention relates to an easy to assemble, mix-or-match, three component necktie that once assembled and adjusted for a person's neck size, can be quickly and easily put-on and taken-off for day-to-day wear while giving the appearance of a conventionally knotted necktie.

2. Description of the Prior Art

Neckties are woven, decorative fabric products that are tied around a wearer's neck. Typically, tieing the knot and obtaining the proper length for the display portion or streamer of the necktie can be an inconvenient and toilsome task.

Since the introduction of the one piece, tie-it yourself necktie, neckties with a "pre-tied" knot have been popular in the apparel market. Neckties whose knot apparatus is separate from the tie streamer have been used to create different design patterns by applying a fabric or pattern that is different than that of the tie streamer.

The prior art which may be relevant to this invention is described hereinafter.

U.S. Pat. No. 4,368,544 to Smith discloses a convertible necktie that includes a streamer that plugs into a triangular knot body which is then fastened around the wearer's neck with a releasable fastener strap attached to this knot body. The streamer has a cylindrical plug at one end which is inserted into the knot body and held in place by a retainer bushing. Both the knot body and the streamer can be covered with the same or with different fabric. Knobs protruding from the knot body fit into corresponding holes in the fastener strap so as to fasten the tie around the wearer's neck. One end of this strap is provided with a series of holes so as to provide some means of adjusting the necktie to fit a particular neck size.

U.S. Pat. No. 4,875,239 to Patterson, Jr. discloses support and fastening means for producing a pre-tied necktie. This necktie uses a triangular, knot-shaped plastic insert with a central post and two end posts for attaching a streamer and a neckband. A one piece neckband has holes located in its mid section and spaced to mate with the posts on the plastic insert. This neckband is first mounted onto these holes and then the streamer is mounted over it. The streamer has two holes located such that one hole can be mounted on the central post of the plastic insert, the streamer can then be wrapped around this insert so as to completely cover it from view and then the second hole slips over the central post and a fastener is attached to hold the entire assembly together. The assembled necktie is fastened around a wearer's neck and retained in place by mating the neckband ends using hook and loop fasteners mounted thereon.

U.S. Pat. No. 4,972,523 to Begg discloses a necktie retainer for attaching the display portion or streamer and the tail end of a conventional necktie to a button on the wearer's shirt. This retainer comprises an elliptically-shaped retaining band that attaches to a button on the wearer's shirt. The wearer then slides the tail end of the necktie through a slot in this retaining band so as to hold the tail end of the necktie adjacent to the wearer's shirt. A hook and loop fastener is either glued or fastened to the back of the streamer and a mating fastener is incorporated into the front surface of the retainer. When these fasteners mate, the streamer is held against the retainer and thus against the wearer's shirt.

U.S. Pat. No. 5,088,120 to Yen discloses a necktie assembly wherein a necktie is looped through an elongated, slotted adjusting plate until the appropriate streamer length is displayed. Then the ends of a neck rope are run through a box like retainer which is placed inside a knot shaped sheath. This retainer is held in the sheath by running the ends of the neck rope through slots in this sheath. The streamer and tail ends of the necktie are then placed in this sheath which is slid up the necktie until this sheath is stopped by the adjusting plate. The sheath covers and is held in place by the adjusting plate.

The present invention overcomes many of the drawbacks and deficiencies of prior pre-tied neckties and provides a unique, easy to assemble and adjust knotless necktie that looks like a conventional knotted necktie.

OBJECTS AND SUMMARY OF THE INVENTION

The present invention provides a three component assembly wherein each component, the streamer, the knotshaper, and the neckband, can be manufactured from the same or from different materials, design patterns or colors.

A principle object of the present invention is to provide a pre-formed necktie that is easy for the wearer to assemble and adjust to their neck size.

Another object of the present invention is to provide a necktie that can be easily wrapped around the wearer's neck and then tightened without the need to reassemble the components or to tie a knot each time the necktie is worn.

Still another object of the present invention is to provide a multitude of different material, color and pattern combinations by interchanging the three components of the necktie, the knotshaper, the streamer, and the neckband. For example, by interchanging the components of three complete neckties, nine different color, pattern and material necktie combinations can be created.

Yet other objects of the present invention are to provide a necktie whose streamer can be easily lengthened or shortened, whose neckband can be easily adjusted to the wearer's neck size, and whose neckband, once adjusted, retains that adjustment, until readjusted.

A further object of the present invention is to provide a stylishly attractive necktie wherein the streamer, knotshaper and the neckband material can be the same or each can be a different material, pattern or color.

A still further object of the present invention is to provide a necktie wherein a segment of the neckband can be threaded through the streamer so as to create a visually contrasting pattern or color against the background of the streamer.

Yet another object of the present invention is to provide a natural-looking preformed necktie "knot" whose size can be adjusted to meet the preference of the wearer and once adjusted will retain that knot appearance until readjusted.

Another object of the present invention is to provide an assemble-it-yourself necktie that looks like a conventional knotted necktie when the necktie is worn.

Other objects and advantages will be apparent from the following description of the invention, and the novel features of the invention will be particularly pointed out hereinafter in the claims.

BRIEF DESCRIPTION OF THE DRAWINGS

The invention is illustrated in the accompanying drawings in which:

FIG. 3 shows a rear pictorial view of the knotshaper component attached to the neckband component.

FIG. 4 shows a sectional view of the length adjuster with the collar segment of the neckband threaded through this adjuster along line 4—4 of FIG. 3.

FIG. 5 shows a sectional view of the stay contained within the neckband tail segment along line 5—5 of FIG. 3.

FIG. 6 shows a frontal view of the knotshaper.

FIG. 7 shows a right side view of the knotshaper along line 6—6 of FIG. 6.

FIG. 8 shows a rear view of the knotshaper with the streamer inserted.

FIG. 9 shows a rear view of the knotshaper with the streamer length adjusting end folded in on itself.

FIG. 10 shows a right side view of the knotshaper with the streamer length adjusting end folded in on itself.

FIG. 11 shows a right side view of the knotshaper with the right wing removed, the streamer, and the tongue of the knotshaper tucked into the knotshaper.

FIG. 12 shows a rear view of an assembled necktie with the neckband tail segment positioned to be inserted into the knotshaper.

FIG. 13 shows a rear view of an assembled necktie with the neckband tail segment drawn through the knotshaper and positioned behind the streamer.

DETAILED DESCRIPTION

Figure 1:
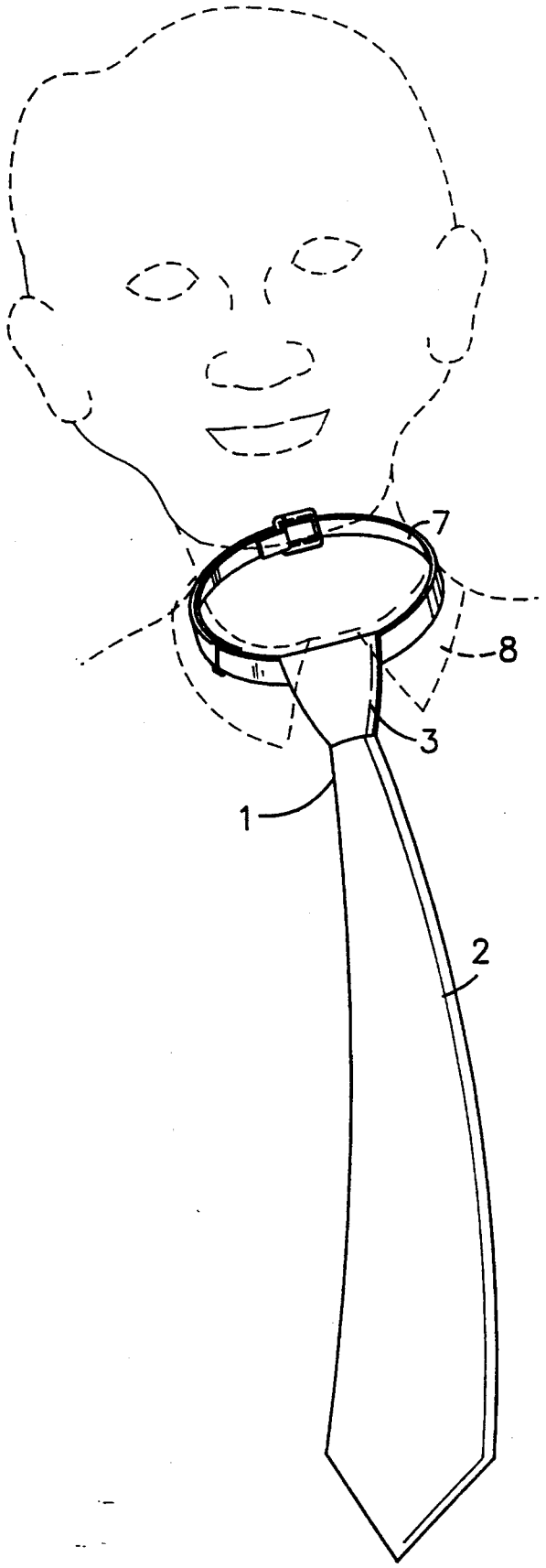
FIG. 1 is a pictorial frontal view of an assembled necktie as it would be normally worn.

The hi-fashion knotless necktie 1 of FIG. 1 of the present invention integrates three distinct components into an easy to assemble and adjust necktie that gives the appearance of being a fashionable, knotted necktie. The knotless necktie comprises a streamer 2 of FIG. 1, a knotshaper 3 and a neckband 7. After the necktie is assembled, the neckband is adjusted to the neck size of the wearer, the neckband is placed around the wearer's neck or shirt collar 8, the knotshaper is then brought up snug to the neck or shirt collar and the shirt collar is turned down to hide the neckband as in a conventional knotted necktie.

Figure 2:
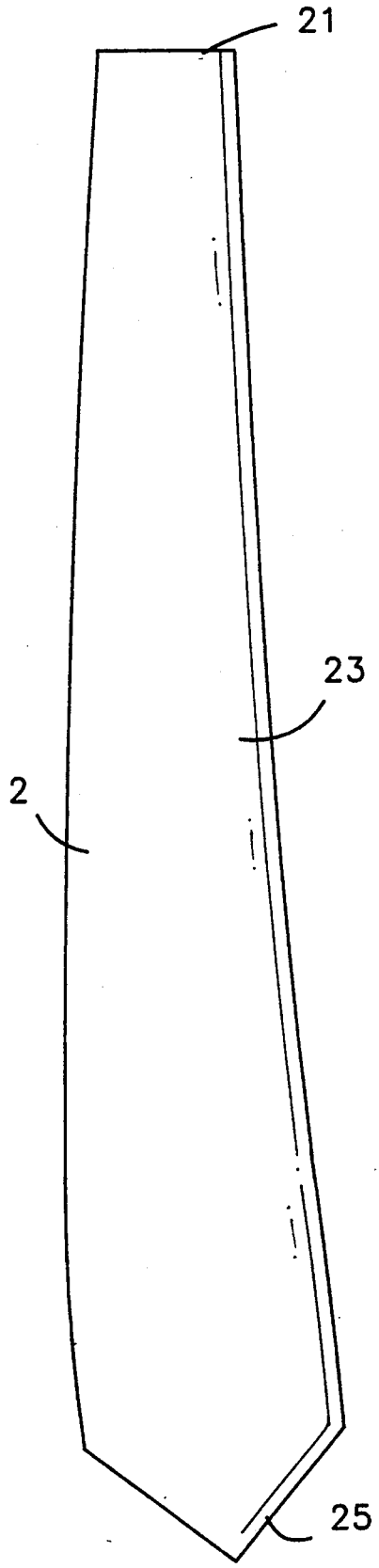
FIG. 2 shows a frontal view of the display streamer component of the necktie.

A streamer 2 of FIG. 2 comprises the display component of the necktie. This streamer is shaped similar to the display portion of a conventional necktie. The streamer comprises a length-adjusting end 21, a front 23, a bottom end 25, a back 27 of FIG. 8 and a seam 28. The streamer is typically made from a strip of material that is folded and creased to create a truncated, longitudinal triangular-shape and then joined at the seam 28 on the back 27. The material of the streamer is typically a woven, flexible fabric with a fashionable design and colors embedded therein, although the material used may be of any shape retaining material that is suitable for decorative neckwear. One of the unique advantages of the present invention is that the material, color and design pattern of the streamer 2 of FIG. 1 can differ from the material, color and design pattern of the knotshaper 3 and of the neckband 7.

The streamer 2 of FIG. 2 can be made in any fashionable length and to fit individuals with different body sizes such as short or long chested adults or children. Typically the streamer is from 12 to 18 inches long.

The knotshaper 3 of FIG. 3 is shown attached to the neckband 7. The knotshaper comprises a butterfly-shaped body 30 with a tongue 31 located at the upper portion of the body, a fold 35, a wing 37, and an extension wing 39. An extension strap 45 can be an integral part of this body 30 or it can be a separate strap that is attached, such as by sewing, gluing or similar means, to the upper corner 40A of the extension wing 39. The extension strap 45 connects to and terminates at an O-fastener 49.

The body 30 is made by shaping material, such as by cutting, sewing, stamping, or the like, to form a back surface 55 of FIG. 3 and 7: by shaping material, such as by cutting, sewing, stamping, or the like, to form a front surface 56 of FIG. 6 and 7; by placing tongue padding 61 between the front and back material that forms the tongue 31 of FIG. 7; by placing body padding 62 between the front and back material that forms the body section encompassing the wings 37 and 39; and then sealing the edges of the front and back material to each other by sewing, gluing, or the like. Typically, the thickness of body padding 62 is only 10 to 25 percent the thickness of tongue padding 61. The tongue padding gives the tongue 31 the bulk needed to hold the streamer 2 in place in the knotshaper 3 and to form the shaped knot so typical of a conventional knotted necktie. The body padding 62 aids in creating smooth, wringle-free sloped sides for the knotshaper 3 and in maintaining a wringle-free surface across the front of the knotshaper when the necktie is assembled and the knotshaper is tightened.

The tongue 31 is an elongated shape that is wide at the fold 35 and narrower at the insertable end 33. The fold 35 is typically formed by stitching across the material located above wings 37 and 39.

Wings 37 and 39 of FIG. 3 comprise eyelets 41A and 41B and a lace 43 attached to the lower corner 44 of each of these wings. Eyelets 41A and 41B are positioned near the outer edge of each wing, with the upper eyelets 41A being positioned in close proximity to their respective upper corners 40A and 40B, respectively. Lower eyelets 41B are positioned between the upper eyelets and the lower corner 44 of the wings. A typical placement is to position a lower eyelet at a point below the upper eyelet that is about one-third of the distance between the upper eyelet and the lower corner of the wing.

Extension strap 45 comprises a narrow strip of material connected at one end to the upper corner 40A of extension wing 39, extending a short length, typically two to four inches, wrapping around the knotshaper leg 51 of the O-fastener 49, and then terminating by fastening the extension strap anchor 47 to the extension strap by sewing, gluing, or the like. O-fastener 49 provides a means for connecting the knotshaper 3 to the neckband 7.

Neckband 7 of FIG. 3 comprises a narrow strip of material with an anchor 79 of FIG. 3 and 4, an anchor segment 81, a connection segment 83, a collar segment 85, a tail segment 89, a tail end 91, an enclosed stay 93 and a length adjuster 71. The neckband is typically made from a strip of material that is folded and creased to create a narrow, longitudinal band which is joined at the seam 87. The material of the neckband is typically a woven, flexible fabric with a fashionable design and colors embedded therein although the material used may be any material that is suitable for decorative neckwear. One of the advantages of the present invention is that the material, color and design pattern of the neckband 7 can differ from the material, color and fashion design of the knotshaper 3 of FIG. 1 and of the streamer 2.

Anchor end 79 of FIG. 3 and 4 of the neckband is wrapped around anchor leg 77 of the length adjuster 71 and then attached to the material of the neckband anchor segment 81, by sewing, gluing or the like, so as to permanently attach length adjuster 71. The connection segment 83 of the neckband is wrapped around the neckband leg 53 of O-fastener 49 to attach the neckband to the knotshaper 3.

The collar segment 85 of FIG. 3 and 4 of the neckband is threaded through the length adjuster 71 by passing collar segment 85 under anchor leg 77, over center leg 75, and under outer leg 73. The length adjuster is moved along the collar segment 85 to adjust the length of the neckband to fit an individual wearer's neck. Once adjusted, the knotless necktie can be put-on and taken-off, time and time again, without further adjustment for the wearer's neck size.

The tail segment 89 of FIG. 3 and 5 contains stay 93 and drapes behind streamer 2 of FIG. 1 when the knotless necktie is worn. The tail end 91 of FIG. 3 and 5 is sealed by sewing, gluing or the like, so as to retain stay 93 within the neckband. Stay 93 provides sufficient stiffness so that the tail segment 89 can be easily inserted into and through the knotshaper 3 when the wearer puts on the knotless necktie.

Alternatively, stay 93 is permanently fastened in the tail segment 89 by sewing, gluing, or the like. In this variation, tail end 91 may be left open or it may be sealed.

The knotless necktie invention is assembled for wearing as shown generally in FIG. 8 through 13 and as described in the following paragraphs.

Knotshaper 3 of FIG. 8 is positioned with its back surface 55 facing up and tongue 31 extended upward and in the unfolded position. Laces 43 are cross-laced through eyelets 41B and then through eyelets 41A in the same fashion as lacing shoestrings through shoe eyelets. Clamp 65 is slid over the lace ends 63 and partially along laces 43 so as to hold both laces together and to start drawing wings 37 and 39 together. Clamp 65 is an O-shaped fastener, or the like, comprised of metal, plastic or a similar material, that can be easily slid over the laces 43 and then tightened with finger pressure to ensure a good friction grip on these laces.

Then, streamer 2 is positioned with the back 27 facing up, the length-adjusting end 21 of streamer 2 is inserted under the lower corner 44 of the wings, passed under the laces 43, drawn out at the top of the wings and laid flat on the back surface 55 of tongue 31. Length-adjusting end 21 is then folded over on itself to shorten the length of streamer 2 to the length desired by an individual wearer and to form folded end 29 of FIG. 9, 10 and 11. Streamer 2 is then pulled downward until the folded end 29 is at or somewhat below fold 35 of FIG. 10 and 11.

Tongue 31 is folded over at fold 35 and the insertable end 33 is slid over the folded end 29 of the streamer 2, and under laced wings 37 and 39 until insertable end 33 extends slightly below, from about one-quarter to three-quarters of an inch, the lower corners 44 of FIG. 11. Clamp 65 is then slid along laces 43 to a tightened position 65A of FIG. 11 so as to pull wings 37 and 39 together. This action increases the pressure on the tongue 31, frictionally retains streamer 2 in place, stretches the material across the front of the knotshaper and controls the appearance of the knotshaper by varying its size. Each wearer can position clamp 65 to select the tightness that creates the "knot shape" that is most pleasing.

Neckband 7 of FIG. 12 is attached to the O-fastener 49 of extension strip 45 as previously described. The wearer then drapes neckband 7 around their neck, brings the knotshaper 3 up to their throat, crosses the neckband tail segment 89 behind the knotshaper 3 and moves length adjuster 71 along collar segment 85 to lengthen or shorten the neckband until the tail segment 89 extends the desired length below the knotshaper and the collar segment 85 is adjusted to the wearer's neck size. Once adjusted, no further adjustment for neck size need be made.

Lace ends 63 of FIG. 12 and 13 and the slack portion of laces 43 are tucked behind an upper corner 40A or 40B. This completes the assembly and neck size adjustment of the knotless necktie.

To wear the knotless necktie, the wearer places the neckband 7 of FIG. 13 around their neck or typically their turned-up shirt collar, inserts the neckband tail end 91 under laces 43 and wings 37 and 39, and then pushes the tail segment 89 through the knotshaper until it emerges at the bottom of the knotshaper. The wearer then pulls the tail segment 89 downward until the knotshaper 3 is positioned in a comfortable and/or snug position against their neck or their shirt collar. Typically, the shirt collar 8 of FIG. 1 is then turned down to cover the neckband collar and connection segments 83 and 85 of FIG. 13 and the extension strap 45. Thus, when worn under a conventional shirt collar, only the body of the knotshaper which looks like the knot in a conventional knotted necktie and the streamer are fashionably displayed.

Due to the independence of the three components of the knotless necktie: the streamer, the knotshaper and the neckband, various fashionable combinations may be easily and economically assembled. Each of these components could be made of the same material, design pattern and color; or one or more components could differ in material, design pattern and/or color. For example, a wearer could have three complete knotless neckties for a total of nine components, each of which differs in material, color and design. These can be easily disassembled and reassembled to create nine distinct knotless neckties by interchanging (mix or match) these components.

Due to the independence of the components of the knotless necktie, individual components could be marketed separately and easily assembled by the wearer.

Figure 14:
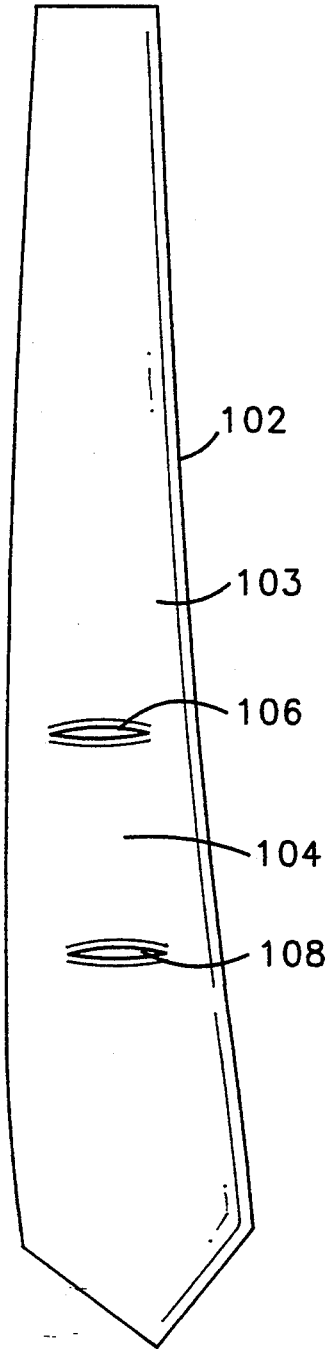
FIG. 14 shows a front view of an alternative tail-display streamer.
Figure 15:
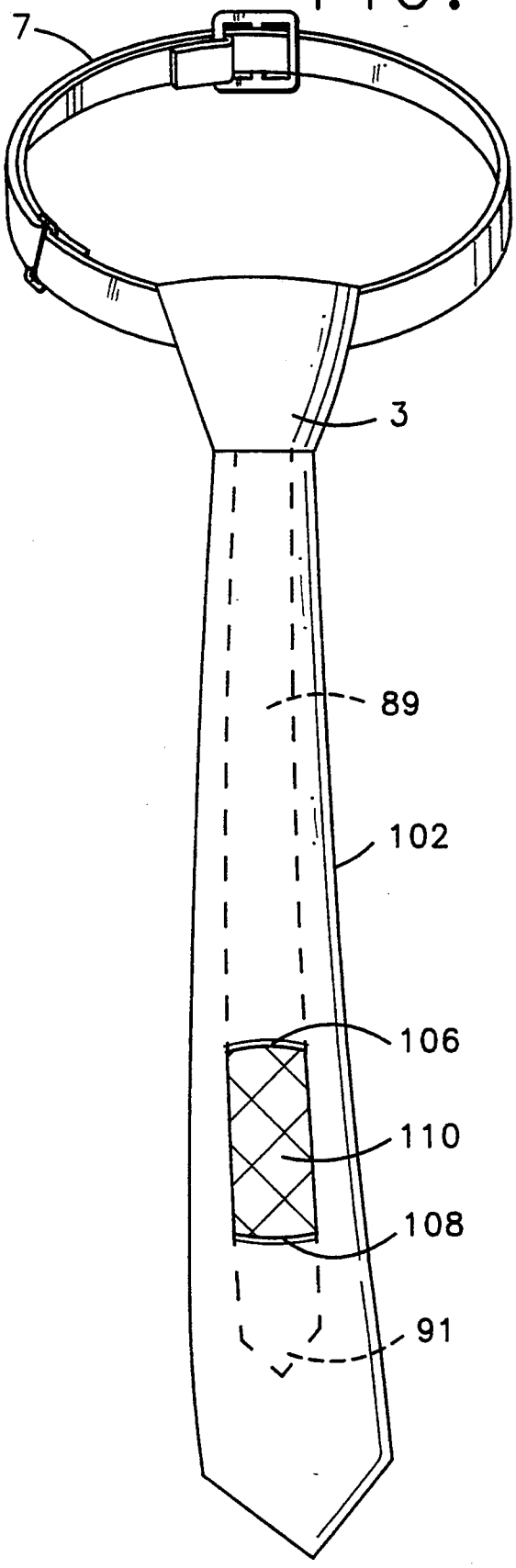
FIG. 15 shows a front view of an assembled necktie with a section of the neckband tail display segment covering a portion of the front of the streamer.

An additional variation of the knotless necktie is created by using a tail-display streamer 102 of FIG. 14. This streamer is the same as described for streamer 2 but with the additional of a plurality of elongated openings spaced horizontally along the streamer front 103. An upper opening 106 of FIG. 14 and 15 and a lower opening 108 can be easily made in the same fashion as a button hole is made. The width of the elongated opening is typically sized to correspond to the width of the tail display segment 110 of the neckband. To create an additional knotless necktie fashion design, the neckband tail end 91 is first passed through the upper opening 106 from the back of the tail-display streamer 102 of FIG. 15. Then tail end 91 is passed through the lower opening 108 from front to back of tail-display streamer 102 and pulled downward until tail display segment 110 is displayed over streamer front segment 104 of FIG. 14.

Further variations of the tail-display streamer are created by adding a plurality of elongated openings horizontally along the streamer and then weaving the tail end of the neckband through these openings to create a design wherein portions of the neckband tail segment cover the front of the tail-display streamer between elongated openings.

While only a few embodiments have been illustrated and described, many variations may be made in the particular design and configuration without departing from the scope of the invention as set forth in the appended claims.

What I claim is:

1. A necktie comprising a streamer, a knotshaper and a neckband wherein said knotshaper comprises a butterfly-shaped body with a tongue located at an upper portion of the body, a fold, a wing, and an extension wing;

wherein the extension wing attaches to one end of an extension strap, a second end of said extension strap connects to a fastener means, and said fastener means connects the neckband to the knotshaper:

wherein the body of the knotshaper further comprises: a front surface, a back surface, padding placed between said front surface and said back surface, said padding located in the tongue being thicker than said padding located in the body region between said wing and said extended wing.

2. A necktie as claimed in claim 1 wherein the neckband comprises:

a narrow strip of material, an anchor, an anchor segment, a connection segment, a collar segment, a tail segment a tail end, an enclosed stay sealed into said tail end and of a stiffness sufficient to enable the tail end to be inserted into and slid through the knotshaper, and a length adjuster.

3. A necktie as claimed in claim 2 wherein:

said anchor of the neckband wraps around an anchor leg of said length adjuster and then attaches to the anchor segment, said connection segment of the neckband wraps around a neckband leg of a fastener means connected to an extension strap thus attaching the neckband to the knotshaper, said collar segment of the neckband being threaded through said length adjuster by passing said collar segment under an anchor leg of said length adjuster, over a center leg of said length adjuster and under an outer leg of said length adjuster.

4. A necktie as claimed in claim 1 wherein the streamer comprises:

a length-adjusting end that folds over on itself to shorten length of said streamer, a front, a bottom end, a back, and a seam.

5. A necktie comprising a streamer, a knotshaper and a neckband:

wherein said knotshaper comprises a butterfly-shaped body with a tongue located at upper portion of the body, a fold, a wing, and an extension wing; wherein the body of the knotshaper further comprises:

a front surface, a back surface, padding placed between said front surface and said back surface, said padding located in the tongue being thicker than said padding located in the body region between said wing and said extended wing.

6. A necktie as claimed in claim 5 wherein said wing and said extended wing of the body of the knotshaper further comprise:

a plurality of eyelets positioned near the outer edge of each wing, a lace attached to a lower corner of each of said wings, said laces coacting with said eyelets to provide a means of tightening the knotshaper so as to retain said streamer and to tighten said knotshaper into a shape that looks like a shaped knot that is typical of a conventional knotted necktie.

7. A method for assembling a knotless necktie comprising a streamer, a knotshaper and a neckband, said method comprising:

A. positioning a back surface of the knotshaper so that said surface faces up,

B. positioning a tongue of the knotshaper to extend upward and in an unfolded position, C. cross-lacing a lace attached to a wing of the knotshaper and a lace attached to an extended wing of the knotshaper through a set of lower eyelets and then upper eyelets located in said wings, D. sliding a clamp over an end of each of said laces and partially along said laces so as to hold said laces together and to start drawing said wing and said extended wing together, E. tightening said clamp with finger pressure to provide a friction grip on said laces, F. inserting a length-adjusting end of the streamer under a lower corner of both the wing and the extended wing, under the laces, and then positioning said length-adjusting end above a fold in the knotshaper, and laying said length-adjusting end against the back surface of the tongue, G. folding said length-adjusting end over onto itself to shorten the length of the streamer to the length appropriate for a wearer and to form a folded end, H. pulling the streamer downward until said folded end is below said fold in the knotshaper, I. folding over the tongue at said fold, J. inserting an insertable end of said tongue over the folded end of the streamer, under said laces and under said wing and extended wing until said insertable end extends below a lower corner on both the wing and the extended wing, K. sliding said clamp along said laces toward said wing and extended wing so as to pull said wing and extended wing together, L. adjusting the position of said clamp along the length of said laces to select a tightness on said tongue and said wing and said extended wing of the knotshaper to create the appearance of a knot shape of a conventional knotted necktie, M. inserting a tail end of the neckband through a fastener means attached to an extension strap of the knotshaper and pulling said tail end through said fastener means until a connection segment of the neckband is wrapped around a neckband leg of said fastener means, and N. threading said tail end through a length adjuster and pulling said tail end until a collar segment of the neckband is threaded into said length adjuster thus completing the assembly of the knotless necktie.

8. A necktie comprising a streamer, a knotshaper and a neckband:

wherein said knotshaper comprises a butterfly-shaped body with a tongue located at an upper portion of the body, a fold, a wing, and an extension wing;

wherein said extension wing attaches to one end of an extension strap, a second end of said extension strap connects to a fastener means, and said fastener means connects the neckband to the knotshaper;

wherein said wing and said extension wing further comprise: a plurality of eyelets positioned near the outer edge of each wing, a lace attached to a lower corner of each of said wings, said laces coacting with said eyelets to provide a means of tightening the knotshaper so as to retain said streamer and to tighten said knotshaper into a shape that looks like a shaped knot that is typical of a conventional knotted necktie.

* * * * *